United States Patent [19]

Demonsant et al.

[11] Patent Number: 4,770,441

[45] Date of Patent: Sep. 13, 1988

[54] DEVICE FOR PRACTISING ALTERNATELY CONVENTIONAL SKIING AND MONOSKIING USING A PAIR OF SKIS

[76] Inventors: Michel Demonsant, 19 rue Gilbert, CH - 1217 Meyrin; Michel Burgener, 18 chemin des Pontets, CH - 1212 Grand-Lancy, both of Switzerland

[21] Appl. No.: 944,236

[22] Filed: Dec. 18, 1986

[30] Foreign Application Priority Data

Dec. 30, 1985 [CH] Switzerland ..... 5552/85

[51] Int. Cl.[4] ..... A63C 11/00

[52] U.S. Cl. ..... 280/818

[58] Field of Search ..... 280/611, 818, 601, 809

[56] References Cited

U.S. PATENT DOCUMENTS 3,627,349 12/1971 Barry ..... 280/818
3,862,764 1/1975 Hartz ..... 280/818

FOREIGN PATENT DOCUMENTS 0159952 3/1985 European Pat. Off. .
876971 5/1953 Fed. Rep. of Germany ..... 280/818
7901977 7/1981 France .
8407690 5/1984 France .
2553670 4/1985 France ..... 280/818

*Primary Examiner*—John J. Love
*Assistant Examiner*—Michael Mar
*Attorney, Agent, or Firm*—Ladas & Parry

[57] ABSTRACT

Two pivoting parts (8*a*, 8*b*) each mounted on one of the skis (1, 2) forming a pair are arranged so that each of them cooperates with two retaining parts (7*a*, 7*b*) each fixed on one of the skis. When each pivoting part (8*a*, 8*b*) is fixed via its free end to the retaining part (7*a*, 7*b*) of the same ski, the skis are separate (FIG. 1), whereas when these pivoting parts (8*a*, 8*b*) are rotated through 90° and are fixed via their free end to the retaining part (7*a*, 7*b*) of the other ski, the two skis (1, 2) are locked in position relative to each other (FIG. 2). These parts allow the skier to change from conventional skiing to monoskiing and vice versa, by operating the pivoting parts and without having to remove his skis.

2 Claims, 5 Drawing Sheets

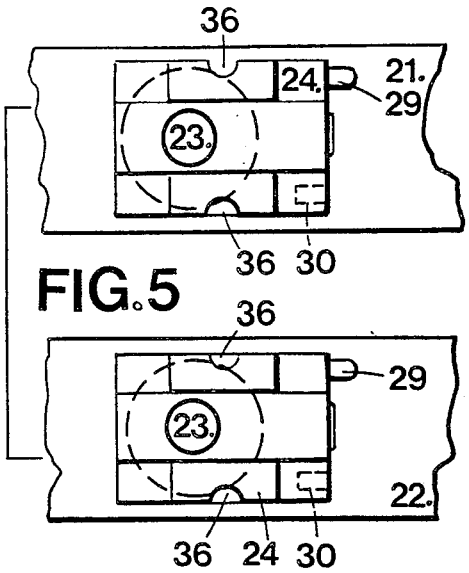
FIG. 5
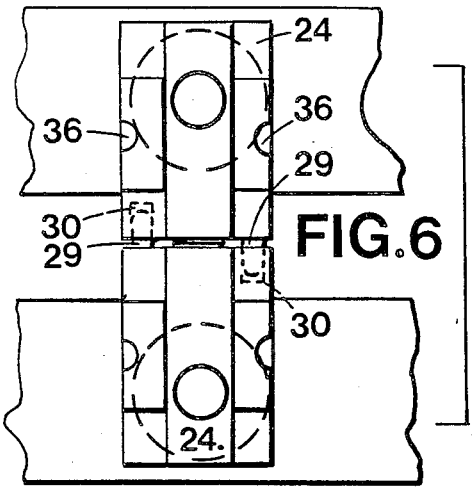
FIG. 6
FIG. 7
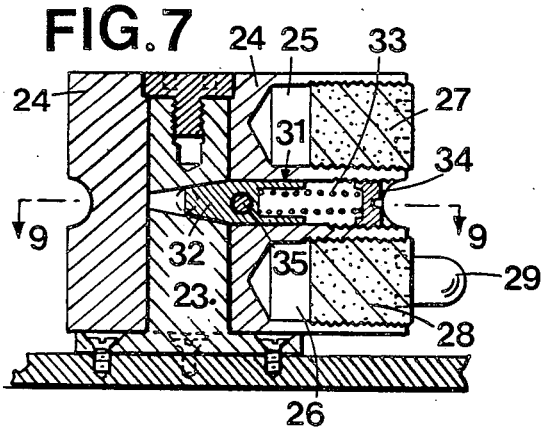
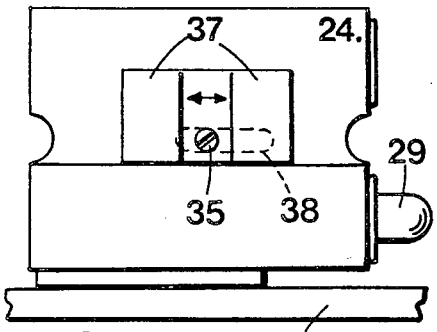
FIG. 8
FIG. 9
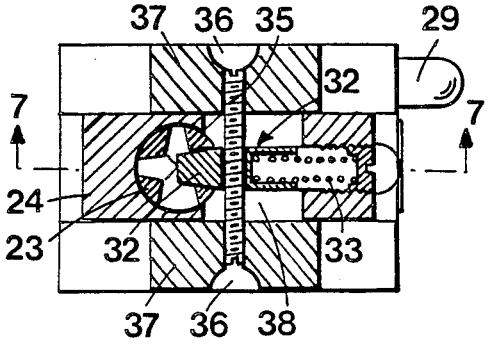

FIG. 12
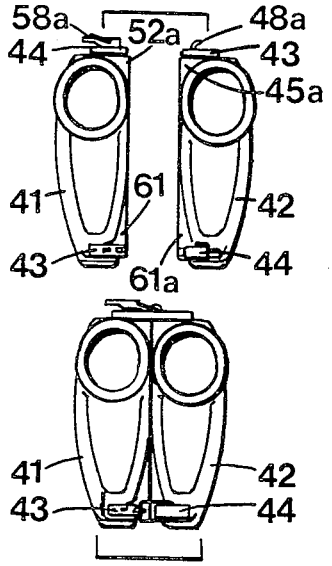
FIG. 10
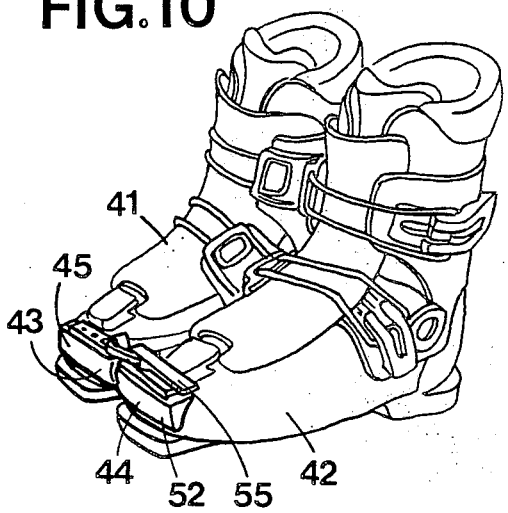
FIG. 13
FIG. 14
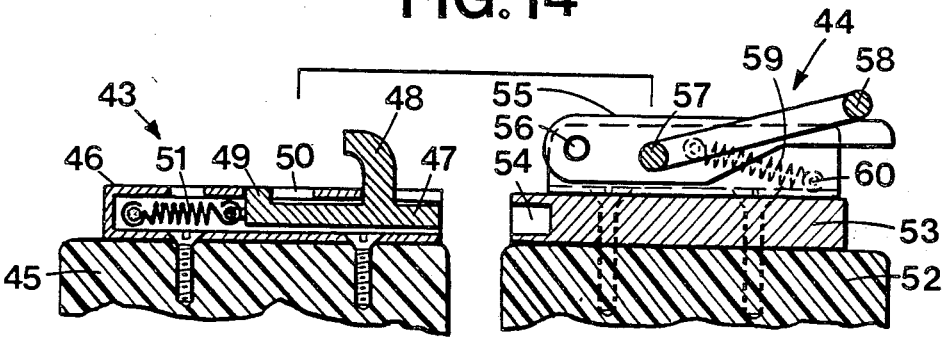
FIG. 15
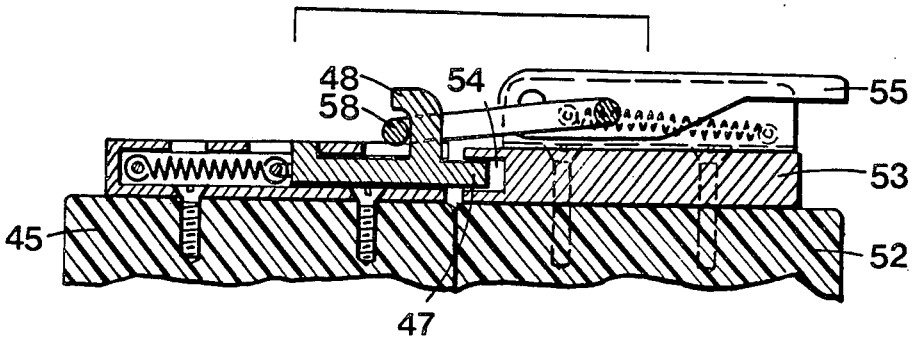

FIG. 16
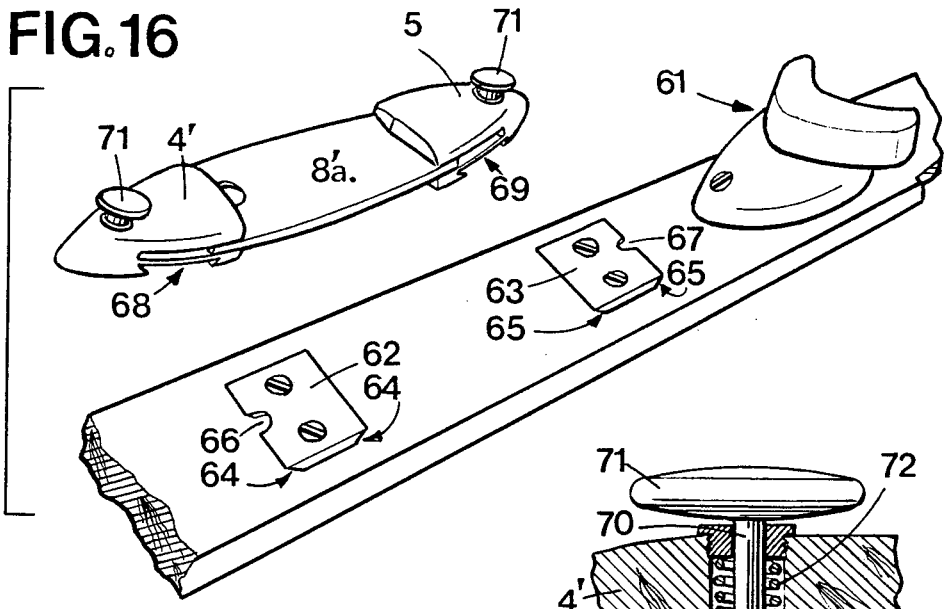
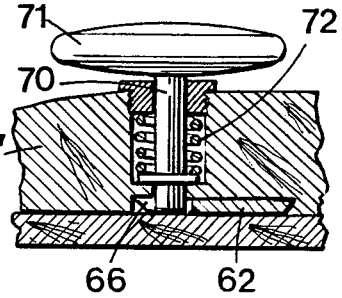
FIG. 17
FIG. 18
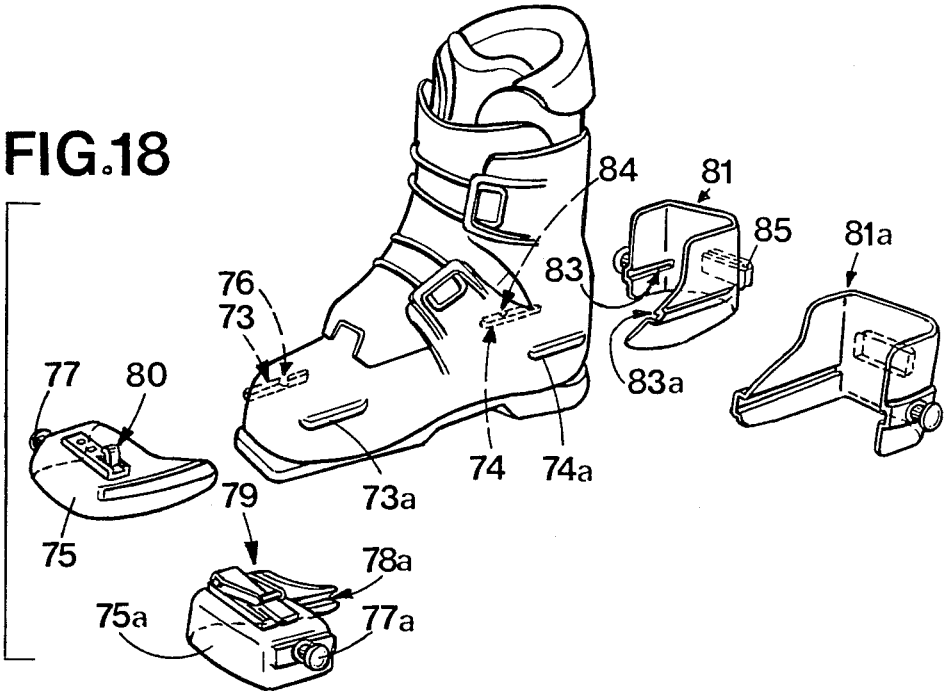

DEVICE FOR PRACTISING ALTERNATELY CONVENTIONAL SKIING AND MONOSKIING USING A PAIR OF SKIS

BACKGROUND OF THE INVENTION

For some time now, monoskiing has been very popular. It offers, in fact, interesting advantages for good skiers. However, this sport has the drawback that it requires special equipment, the monoski, which once fixed to the feet poses a problem for the skier who finds himself on flat ground or at the bottom of a slope.

THE INVENTION

The present invention aims to provide an answer to this problem and relates to a device for practising alternately conventional skiing and monoskiing using a pair of skis, which device has means arranged such that they can be operated by the skier with the skis on his feet, in order, on the one hand, to couple the two skis by arranging them close together and locking them mechanically in position relative to each other, so that combined they form a monoski, and in order, on the other hand, to uncouple the skis and separate them from each other.

BRIEF DESCRIPTION OF THE DRAWINGS

The accompanying drawings show, by way of an example, five embodiments of the device according to the invention.

FIG. 5 is a plan view of a second embodiment of the device in the conventional skiing position.

FIG. 6 is a view similar to FIG. 5, but showing the device in the monoskiing position.

FIG. 7 is a view, in vertical section, of a part of the device according to FIGS. 5 and 6, along the line 7—7 of FIG. 9.

FIG. 8 is a side view corresponding to FIG. 7.

FIG. 9 is a view, in horizontal section, along the line 9—9 of FIG. 7.

FIG. 10 is a perspective view of the third embodiment.

FIG. 12 is a plan view, on a smaller scale, of FIG. 10, the two boots being separated from each other (conventional skiing position).

FIG. 13 is a view similar to FIG. 12, but showing the boots clamped to each other in the monoskiing position.

FIG. 14 shows the mechanism located at the front of the boots shown in FIGS. 10–13, viewed in section and on a larger scale, in the conventional skiing position.

FIG. 15 is a view similar to FIG. 14, but showing the parts assembled in the monoskiing position.

FIG. 16 shows a perspective view of a fourth embodiment.

FIG. 17 shows a detail, in section, of FIG. 16.

FIG. 18 is a perspective view of the fifth embodiment, its various constituent parts being shown separated from each other for the sake of clarity.

PREFERRED EMBODIMENTS OF THE INVENTION

Figure 3:
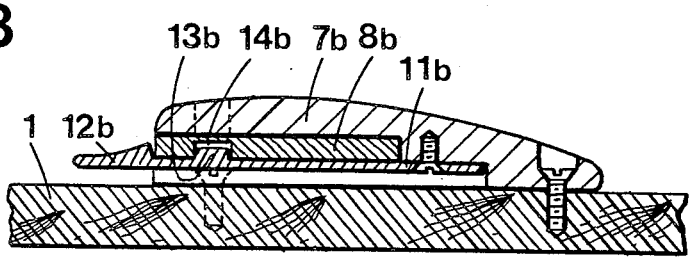
FIG. 3 is a view, in longitudinal section, of a part of the device.
Figure 4:
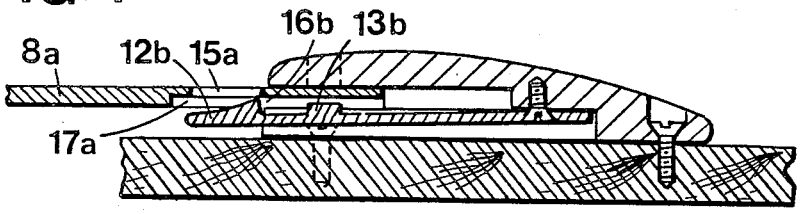
FIG. 4 is a view similar to FIG. 3, but showing the parts in another position.

In FIGS. 1 to 4, 1 and 2 denote the two skis of a pair of normal skis onto which a device consisting of two parts 4 and 5 has been fixed, in front of the usual binding, part of which is indicated by 3. These two parts are identical. The part 4 comprises a body *6a* fixed to the ski 1 and a body *7a* fixed to the ski 2. A connecting piece *8a* is mounted so as to pivot about a fixed pin *9a* in the part 4. The end of the connecting piece *8a*, opposite to the end which rotates about the pivot *9a*, is provided so as to engage in a slot *10a* of the part *7a*. *6b*, *7b*, *8b* and *9b* represent the corresponding parts of 5, indicated on the part 4 by *6a*, *7a*, *8a*, *9a* and *10a*. The part *8a* is able to pivot between the position shown in FIG. 1 where it cooperates with *7a* and the position shown in FIG. 2 where it cooperates with *7b*. Similarly, the part *8b* is able to pivot between the position shown in FIG. 1 where it cooperates with *7b* and the position shown in FIG. 2 where it cooperates with *7a*. FIGS. 3 and 4 are longitudinal sections of the part *7b*, which is identical to *7a*, showing the part *8b* in the positions which it occupies in FIGS. 1 and 2.

An elastic blade *11b*, the free end of which projects at *12b*, is fixed to the bottom side of the part *7b*. This blade *11b* has a boss *13b* which, in the position shown in FIG. 3, cooperates with a recess *14b* provided in the bottom side of the part *8b*. When the boss *13b* is engaged in the recess *14b*, the pivoting part *8b* is kept in the position shown in FIG. 1, which is the position for using the device as a monoski. A similar arrangement exists in the part *7a*, but the drawing shows only the part *12a* corresponding to *12b*. When it is required to change from monoskiing to conventional skiing, pressure is applied, for example using the ski stick, to the projection *12b* so as to bring it into the position shown in FIG. 4, thereby disengaging the boss *13b* from the recess *14b* and allowing the part *8b* to rotate about its pivot *9b*. The part *8a* is also disengaged by applying pressure in the same way to the projection *12a* so as to free the pivoting part *8a*. At this point, the skis may be separated slightly from each other and the pivoting parts *8a* and *8b* are brought into the position shown in FIG. 2, for example using the ski stick, the tip of which is inserted into the holes *15a* and *15b* provided in the parts *8a* and *8b*, respectively.

When the hole *15a* is located opposite the projection *12b*, the boss *13b* engages into a longitudinal slot in the part *8a* and fixes the part *8a* in the conventional skiing position. The same procedure is adopted for the other ski and the skier is thus able to change over from monoskiing to conventional skiing and vice versa without having to take off his skis. In fact, in order to change from the conventional skiing position shown in FIG. 2 to the monoskiing position shown in FIG. 1, it is merely necessary to insert the tip of the ski stick successively into the holes *15a* and *15b* so as to apply pressure onto the ends *12a*, *12b* of the parts *11a*, *11b* forming a locking device, in order to release the parts *8a* and *8b* and allow them to assume the position shown in FIG. 1.

It will be noticed that a recess, which is indicated by *17a* in FIG. 4, allows the part *8a* (and similarly *8b*) to rotate despite the presence of the projecting parts *12b* and *13b*.

In the example according to FIGS. 1 to 4, the means arranged such that they can be operated by the skier with the skis on his feet are purely mechanical means for coupling the two skis arranged close together by locking them in position relative to each other, in the lateral, longitudinal and vertical direction (FIG. 1), and also for uncoupling them.

In the example shown in FIGS. 5 to 9, these means are partly magnetic and partly mechanical.

FIG. 5 shows the two skis 21, 22 of a pair of skis, on each of which a pivot 23 is mounted. This pivot 23 has mounted on it, in turn, a rotating part 24 with two recesses 25, 26 inside each of which a permanent magnet 27, 28 is engaged, this magnet being made of an alloy, such as that sold under the tradename TICONAL, consisting of titanium, nickel and aluminium, and being able to exert a considerable attractive force for a very small volume. The rotating parts 24 of the two skis are identical. Each of them has on its side where the ends of the magnets 27, 28 appear, a bolt 29 intended to cooperate, as will be seen, with a corresponding cavity 30.

The following means are provided so as to lock each of the parts 24, either in the position shown in FIG. 5, or in the position shown in FIG. 6 where these parts are rotated through 90° relative to FIG. 4. Each part 24 has a hole 31 inside which a dowel 32 is able to slide, the body of the said dowel being cylindrical and ending on its left-hand side, as viewed in FIG. 7, in a cone. This dowel 32 is biased by a compression spring 33 so as to occupy the position shown in FIG. 7. A threaded plug 34 screwed inside the hole 31 serves as a bearing surface for this spring. A threaded pin 35 passes through the part 24 and the dowel 32. It also passes through two symmetrical blocks 37 which are able to slide along the part 24. The end of the threaded pin 35 is located at the bottom of two symmetrical cavities 36 provided in the block 37. By gripping the blocks 37 via the cavities 36, it is possible to pull them to the right, as viewed in FIG. 9, so as to disengage the conical part of the dowel 32 from the hole inside which it is engaged inside the pivot 23, as can be seen from FIGS. 7 and 9. The pivot 23 has two perpendicular conical holes, as can be seen in FIG. 9. When the blocks 37 and the dowel 32 have been moved to the right so as to disengage the latter from the pivot 23, the part 24 can be rotated so until, when the pulling force is no longer exerted on 37, the perpendicular conical hole of the pivot 23 is located opposite 32 and the conical end is disengaged from this conical hole so as to lock the part 24 in its new position.

FIG. 5 shows the parts 24 in one of the positions and FIG. 6 shows them in the perpendicular position. When the two parts 24 are thus in the position according to FIG. 6 where the magnets are opposite each other, it is sufficient to bring the skis together so that, owing to the mutual attraction of the magnets, the bolts 29 engage inside the respective holes 30. The function of the magnets is to keep the skis in the clamped monoskiing position and the function of the bolts 29 cooperating with the holes 30 is to prevent any vertical or longitudinal displacement of the skis relative to each other. In this way, the monoskiing position is achieved. If one wishes to change over to the conventional skiing position, the skis must be forced apart slightly so as to disengage the bolts 29 from the holes 30 and, then, the parts 24 rotated so as to bring them again into the position according to FIG. 5.

FIG. 8 shows the slideway 38 of the part 24, inside which the threaded pin 35 is able to move when it is required to change the angular position of the part 24.

Figure 11:
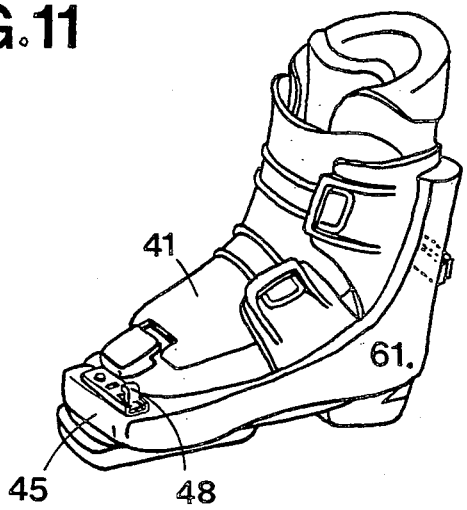
FIG. 11 shows one of the boots shown in FIG. 10.

In the embodiment according to FIGS. 10 to 15, the means arranged such that they can be operated by the skier in order to couple the two skis and uncouple them are no longer fixed on the skis themselves, but on the ski boots. FIGS. 10 to 12 show a pair of boots provided with these means.

FIG. 12 shows the boots in the separated position, used when practising conventional skiing, and FIG. 13 shows the boots rigidly clamped together so that monoskiing is possible when the two boots are fixed in the usual manner to a pair of skis.

At the front of the boots 41, 42, provision is made for a conventional articulated-lever device, indicated by 43 and 44. This device is shown on a larger scale and in detail in FIGS. 14 and 15. The front of each boot is integral with a solid part 45 on which a small housing 46 is fixed, inside which housing an insert 47 with an upwards projecting hook 48 is able to slide. This insert 47 also has a stop 49 engaged inside a slot 50 in the upper surface of the housing 46. A traction spring 51 pulls the insert 47 to the left, as viewed in FIG. 14, into a position where it abuts against the left-hand end of the slot 50. The components shown in the left-hand part of FIG. 14 are located on the boot 41. The boot 42 has fixed to its front a solid part 52 which is similar to 45 and on which there is fixed a plate 53 with a cavity 54, the function of which will be described below. This plate 53 has mounted on it an arm 55 which rotates about 56 and on which a fastener 58 pivots at 57. The assembly consisting of 55, 56, 57 and 58 forms an articulated-lever system, as will be seen below. A traction spring 59, one end of which is fixed to the fastener 58 and the other end of which is fixed to a part 63 which is stationary relative to 53, biases the fastener 58 so that it remains in either of the end positions (FIGS. 14 and 15) into which it has been brought.

In the conventional skiing position, the boots are at a distance from each other (FIG. 12), the insert 47 is in the retracted position inside the housing 46 and the fastener 58 is folded down in the rest position. To change to the monoskiing position shown in FIG. 15, it is merely required to bring the skis together, operate the arm 55 by pivoting it in an anticlockwise direction, as viewed in FIG. 14, so that the fastener 58 engages over the hook 48, and then press down the lever into the position shown in FIG. 15. During these operations, the right-hand end of the insert 47 engages inside the cavity 54, as can be seen in FIG. 15, and the spring 59 keeps the two parts 45 and 52 pressed firmly against each other. At the rear of the boots, means identical to those shown in FIGS. 14 and 15 are provided, ie. a block 45*a* on one of the boots and a block 52*a* on the other boot, these blocks having mounted on them the mechanisms which are shown in the same FIGS. 14 and 15 and which there is no need to describe in detail. The hook 48*a*, corresponding to 48, and the fastener 58*a*, corresponding to 58, have merely been indicated.

Finally, to ensure proper contact between the boots in the monoskiing position, each of the boots has a part 61, clearly visible in FIG. 11, which is made of plastic for example, and which is integral with 52, as regards the boot 41. The other boot 42 has, on its inner side, a symmetrical part 61*a*. The opposite surfaces of the parts 61 and 61*a* are perfectly flat so as to ensure that the boots and, hence, the skis on which they are fixed are perfectly parallel, when the monoskiing position is assumed. Cooperation of the right-hand end 47 with the cavity 54 ensures that the boots, and hence the skis, are locked in position relative to each other, in the longitudinal and vertical direction, when in the monoskiing position.

Figures 1, 2:
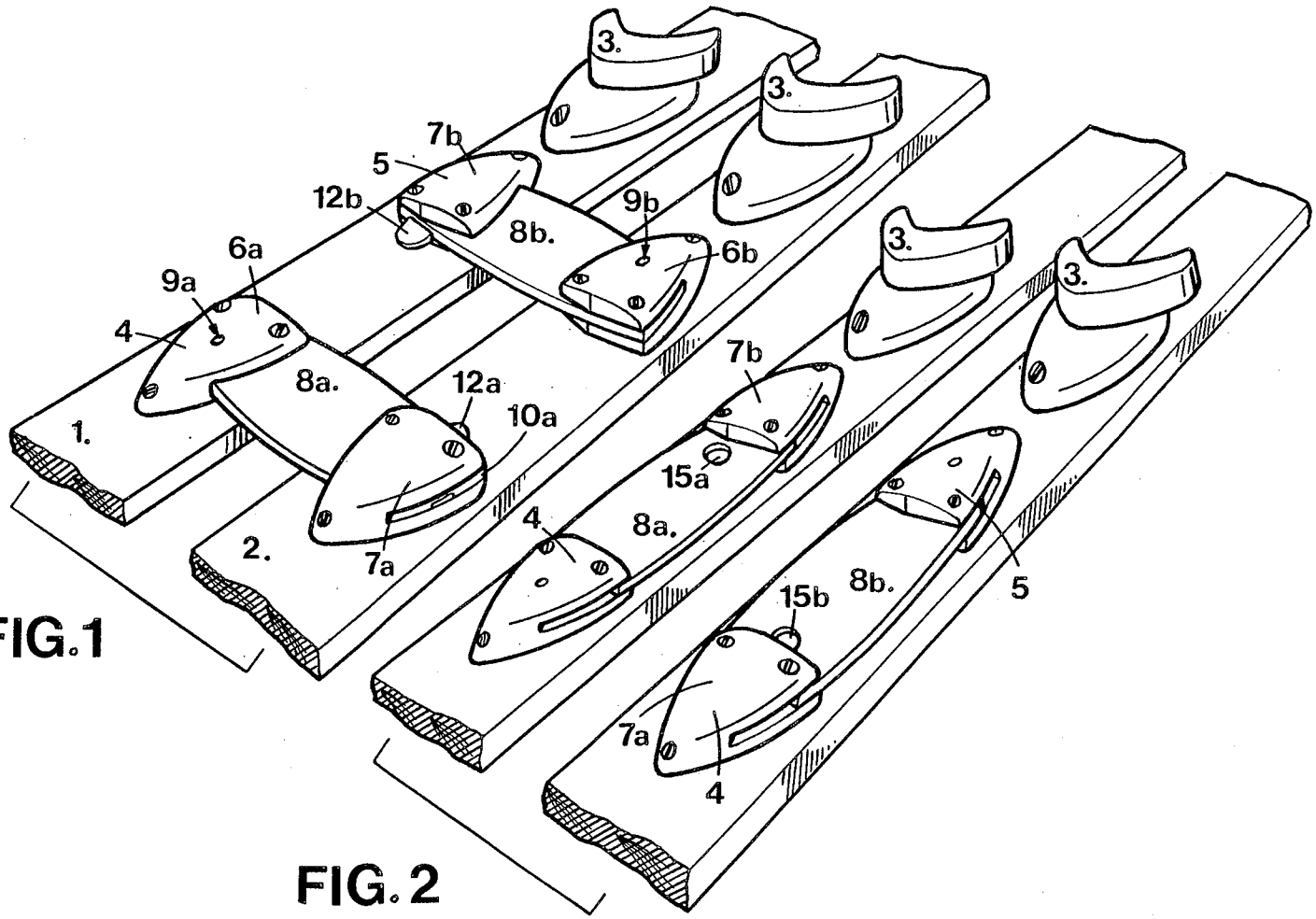
FIG. 1 shows a perpective view of a first embodiment of the device in the monoskiing position.
FIG. 2 is view, similar to FIG. 1, showing the device in the conventional skiing position.

The embodiment shown in FIGS. 16 and 17 is derived from the embodiment according to FIGS. 1 and 2. It differs from the latter in that the parts 4, 5 (with 8*a* and 8*b*) are not permanently fixed on the skis, but can be detached from them as required and almost instantaneously owing to the following means.

FIG. 16 shows only one of a pair of skis, since the arrangement on the other ski is identical.

The Figure shows, in front of the front part 61 of a ski-boot binding, two flat parts 62, 63 screwed onto the top side of the ski and having, when viewed in profile, a dovetail shape, as indicated by 64 and 65. The part 62 has, on its front edge, a semi-circular notch 66, while the part 63 has an identical notch 67 on its rear edge.

The top section of FIG. 16 shows two parts 4', 5' and 8'*a*, corresponding to the parts 4, 5 and 8*a* of FIGS. 1 and 2, respectively. The part 4', instead of being permanently fixed to the ski, as in the case of the part 4, has on its bottom side a transverse dovetail groove 68 which is provided so as to fit, by means of sliding, onto the matching dovetail section 64 of the part 62. Similarly, the part 5' has on its bottom side a transverse dovetail groove 69 which is provided so as to fit, by means of sliding, onto the matching dovetail section 65 of the part 63. It will be easily understood that the parts 4' and 5' can be arranged in position on the ski almost instantaneously by sliding 4' and 5' onto 62 and 63, respectively, after engaging 64 with 68, on the one hand, and 65 with 69, on the other hand. In order to lock 4' and 5' in position on the ski, the following locking means are provided on 4' and 5'. A locking device 70 with a head 71, which is slidably mounted and subject to the action of a compression spring 72 arranged inside a housing of the part 4', is biased by this spring 72 so as to engage, by means of its bottom end, inside the notch 66 of the part 62, thereby locking 4' in position on 62. 5' is fixed in position on 62 using identical means. In order to release 4' from 62 and 5' from 63, it is merely necessary to pull the respective button 71 and slide 4' and 5' sideways in order to release them from the ski.

This arrangement is advantageous in particular for people who, one day, go ski-touring and, another day, practise downhill monoskiing. In the first case, they are able to remove the devices which couple the skis together and ski in the conventional manner using skis which are practically the same as ordinary skis.

The embodiment shown in FIG. 18 is a variation of that according to FIGS. 11 to 15, but in this embodiment the boot is in actual fact like a conventional ski boot, down to the last detail.

Only the right-hand boot is shown. It is made of molded plastic and has two pairs of horizontal side ribs, one pair 73, 73*a* arranged in the front region of the boot, and the other pair 74, 74*a* arranged in the rear region of the boot.

The right-hand boot has a front detachable coupling part 75, and the left-hand boot has a matching front detachable part 75*a*.

The part 75 is shaped so that it can be fixed onto the front part of the right-hand boot. For this purpose, it has two grooves provided so that they engage and slide onto the ribs 73, 73*a*. A locking means similar to that shown in FIG. 17 is provided so as to cooperate with a notch 76 of the rib 73. 77 denotes the operating button corresponding to 71 in FIG. 17.

The part 75*a* matches 75. 78*a* indicates one of its grooves, intended to cooperate with the rib 73*a* on the corresponding left-hand boot.

The part 75*a* is provided, on its upper surface, with an articulated-lever fastener 79 similar to 44 in FIG. 14, while the part 75 is provided with a spring-loaded hook 80 similar to 43 in FIG. 14. It wil be understood that these means enable the front parts of the two boots to be easily and rapidly locked together and unlocked.

The right-hand boot also has a rear detachable coupling part 81, and the left-hand boot a matching rear detachable part 82.

The part 81 has two grooves 83, 83*a* intended to cooperate with the ribs 74, 74*a*. A locking device similar to that provided on 75 is arranged on the part 81, so as to cooperate with a notch 84 of the rib 74 and lock 81 in position on the boot.

A spring-loaded hook 85, similar to 80, is provided on the rear of the part 81, and an articulated-lever fastener, similar to 79, is provided on the rear section of the part 81*a*. These means enable the rear part of the boots to be locked together almost instantaneously, so that monoskiing is possible.

This embodiment offers the advantage that boots practically identical to conventional boots can be used when one wishes to go ski-touring, and that the accessory parts 75, 75*a*, 81 and 81*a* are fitted only when one wishes to practise monoskiing.

What is claimed is:

1. A device for practicing conventional skiing or monoskiing by a skier using a pair of skis, each ski having a toe and a heel binding adapted to receive a ski boot worn by the skier, said device comprising:

means for rigidly coupling said pair of skis together to form a monoski, said means being operable by the skier while the ski boots are secured by the bindings to mechanically lock said skis in a parallel position relative to each other or to uncoupled said skis and separate them from each other, said means being detachably fitted to said ski boots, said means comprising a first pair of longitudinally extending ribs located on the front portion of each ski boot and a second pair of longitudinally extending ribs located on the rear portion of each ski boot, a pair of front members releasably secured to said ski boots, each front member having a pair of grooves for receiving said first pair of ribs located on the front portion of each ski boot, a pair of rear members releasably secured to said ski boots, each rear member having a pair of grooves for receiving said second pair of ribs located on the rear portion of each ski boot, means provided on said front members for releasably locking said front members together, and means provided on said rear members for releasably locking said rear members together.

2. The device as claimed in claim 1, wherein the said front and rear members have a locking mechanism provided so as to cooperate with a notch of one within the respective grooves, for locking these members on the boot when the device is used as a monoski.

* * * * *